US005896591A

United States Patent [19]

Horan et al.

[11] Patent Number: 5,896,591

[45] Date of Patent: Apr. 27, 1999

[54] TOILET AIR FRESHENER

[76] Inventors: Daniel G. Horan; Mary L. Horan, both of 6440 E. Elm St., Fountain, Mich. 49410

[21] Appl. No.: 08/803,117

[22] Filed: Feb. 20, 1997

[51] Int. Cl.[6] ..... E03D 9/04; E03D 5/10

[52] U.S. Cl. ..... 4/213; 4/406; 4/408

[58] Field of Search ..... 4/213, 217, 406, 4/408, 216, 347–352

[56] References Cited

U.S. PATENT DOCUMENTS

| | | | |
|---|---|---|---|
| 1,767,930 | 6/1930 | Kahl | 4/217 |
| 1,998,657 | 4/1935 | De La Croix | 4/213 |
| 2,231,161 | 2/1941 | Hanford | 4/213 |
| 2,881,450 | 4/1959 | Tubbs | 4/213 |
| 3,790,970 | 2/1974 | Bendersky et al. . | |
| 3,887,949 | 6/1975 | Osmond | 4/213 |
| 3,913,150 | 10/1975 | Poister et al. . | |
| 3,953,901 | 5/1976 | Poister et al. . | |
| 4,117,559 | 10/1978 | Boyle | 4/213 |
| 4,168,553 | 9/1979 | Studer | 4/213 |
| 4,175,293 | 11/1979 | Stephens et al. | 4/213 |
| 4,251,888 | 2/1981 | Turner | 4/213 |
| 4,375,704 | 3/1983 | Smith | 4/213 |
| 4,472,841 | 9/1984 | Faulkner . | |
| 4,583,250 | 4/1986 | Valarao . | |
| 4,726,078 | 2/1988 | Carballo et al. . | |
| 4,831,670 | 5/1989 | Velasquez | 4/408 |
| 4,853,981 | 8/1989 | Hunnicutt, Jr. . | |
| 4,914,757 | 4/1990 | Johnson . | |
| 5,054,130 | 10/1991 | Wilson . | |
| 5,079,783 | 1/1992 | Haletsky et al. . | |
| 5,454,122 | 10/1995 | Bergeron . | |

*Primary Examiner*—Charles R. Eloshway
*Attorney, Agent, or Firm*—Chase & Yakimo, L.C.

[57] ABSTRACT

An air treatment device for conditioning air within a conventional toilet bowl includes an air treatment assembly and an automatic flush mechanism. The air treatment assembly includes a cylindrical housing mounted to the rear of the toilet bowl rim with the toilet seat and lid swingably mounted thereto and an air duct having a free end extending into the toilet bowl proper. A seal underlying the toilet seat contacts the toilet bowl rim when the seat is in a horizontal position. Included within the housing are fans which draw air through the duct and a carbon filter to treat the air drawn therethrough. A flush assembly includes a motorized arm having a free end attached to the conventional flapper found in the water tank of the toilet bowl. Upon powering the motor, the arm moves the linked flapper valve from its normal closure position which allows the water to escape from the tank and flush the toilet bowl. A pressure sensitive switch embedded in the toilet seat activates the fans of the air treatment assembly and arm of the flush assembly upon user pressure being exerted on or released from the seat. The switch may be designed so as to alternatively or sequentially activate the air treatment and flush assemblies. The air treatment and flush assemblies effectively treat the foul air associated with a conventional toilet.

11 Claims, 9 Drawing Sheets

TOILET AIR FRESHENER

BACKGROUND OF THE INVENTION

This invention relates to an air freshener device for use with a toilet in order to effectively deodorize the air and flush the toilet subsequent to use.

Various devices have been proposed to treat the foul odors associated with a conventional toilet. Although assumably effective in operation, such devices have been relatively complex structures not easily attached to the toilet proper. Moreover, such devices have not effectively addressed the combined treatment of the fouled air and the automatic evacuation of the toilet contents subsequent to use.

In response thereto we have invented an air freshener device which conditions the foul air and flushes the toilet subsequent to use so as to treat the fouled air and diminish the basis thereof. Our device generally comprises an air treatment assembly forming a hinge for the toilet seat which includes an air duct extending into the toilet bowl. A seal underlying the toilet seat contacts the toilet bowl rim so as to diminish any escape of the fouled air from the toilet bowl except through the air duct. The air treatment assembly includes fans for drawing the air from the toilet bowl through an air duct and a carbon activated filter so as to remove the odors from the drawn foul air. A flush assembly, located within the water tank of the toilet structure, presents a mechanized arm attached to the flush valve. Upon a release of pressure on the toilet seat, a sensor will activate the flush assembly so as to raise the mechanized arm and flapper attached thereto. This action allows the water to flow from the tank and flush the contents of the toilet bowl. The sensor also activates the fans in the air treatment assembly. The combination of the air treatment assembly and automated flush assembly diminishes the odors emanating from the toilet bowl.

It is therefore a general object of this invention to provide a novel air treatment device for use with a conventional toilet.

Another object of this invention is to provide a device, as aforesaid, presenting air treatment and automatic flush assemblies.

Still another object of this invention is to provide a device, as aforesaid, the air treatment assembly functioning as a hinge for a toilet seat.

A more particular object of this invention is to provide a device, as aforesaid, the air treatment assembly utilizing fans for drawing the air from the toilet bowl proper through an air duct and intermediate filter.

Another object of this invention is to provide a device, as aforesaid, the flush assembly controlling the conventional flapper valve located in the water tank of the toilet.

Another particular object of this invention is to provide a device, as aforesaid, the flush assembly being activated by a sensed difference in pressure on the toilet seat.

A further particular object of this invention is to provide a device, as aforesaid, including a seal underlying the toilet seat for contact with the underlying toilet bowl, the air in the toilet bowl being drawn through an air duct of the air treatment assembly.

A further object of this invention is to provide a device, as aforesaid, the air treatment assembly being activated upon either pressure being exerted on or released from the toilet seat.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
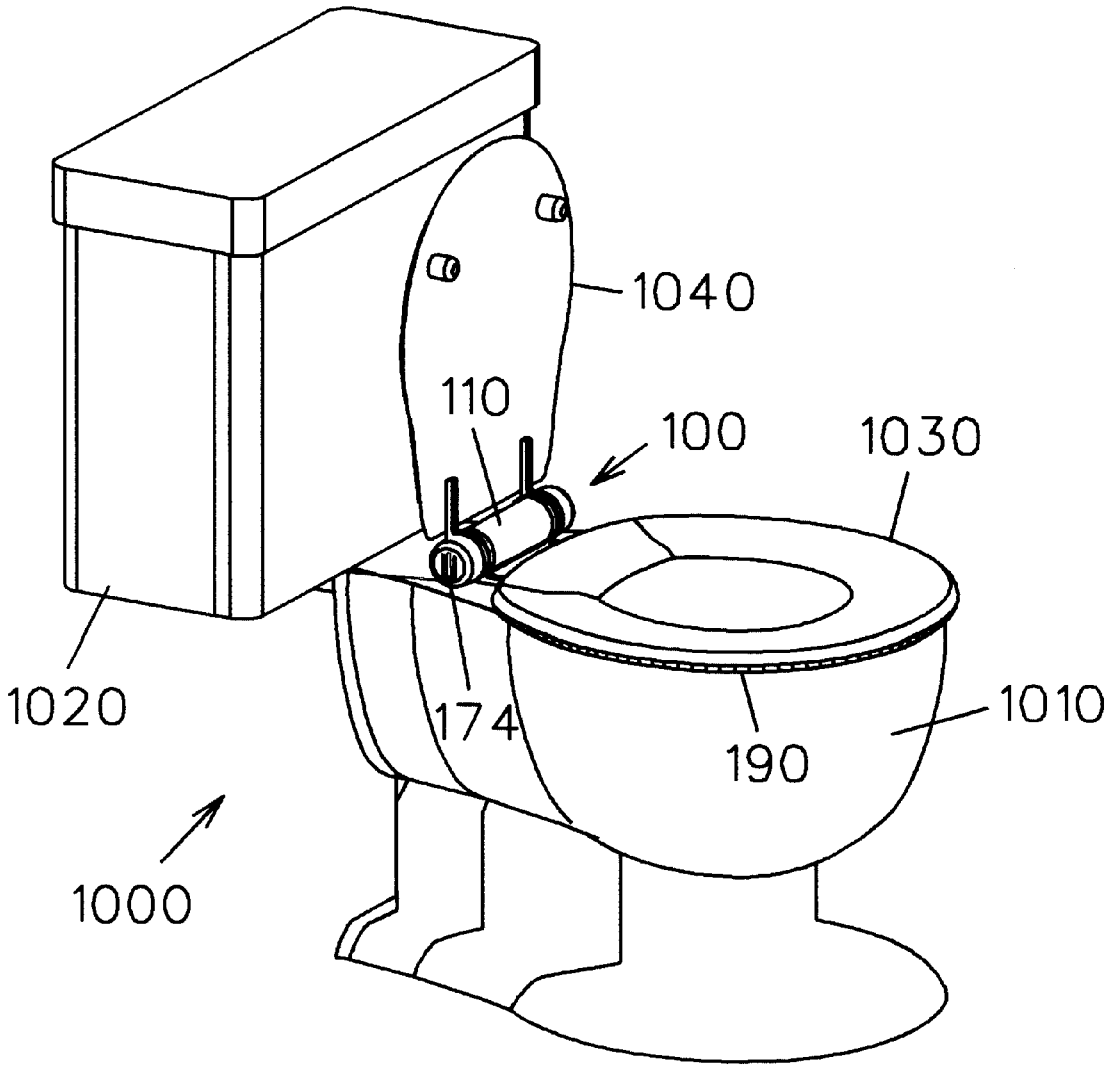
FIG. 1 is a perspective view of a toilet with the air freshener device in place.
Figure 2:
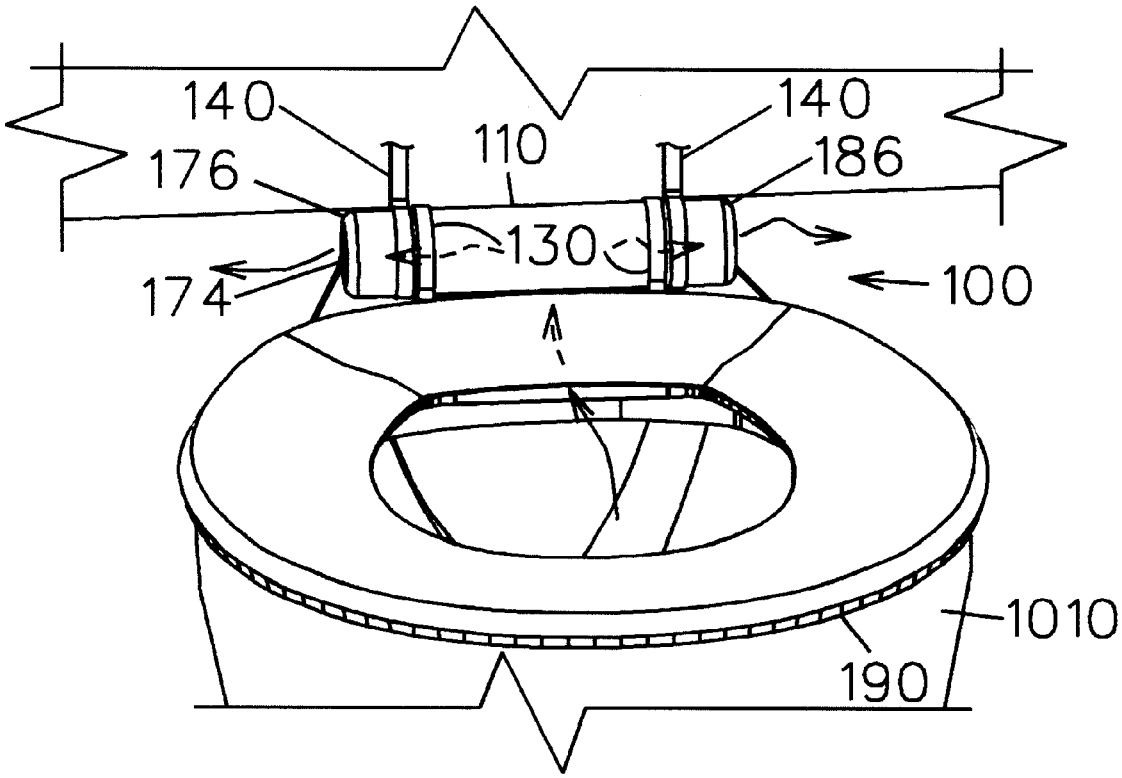
FIG. 2 is a fragmentary front view of the toilet bowl and seat showing the air treatment assembly thereon.
Figure 3:
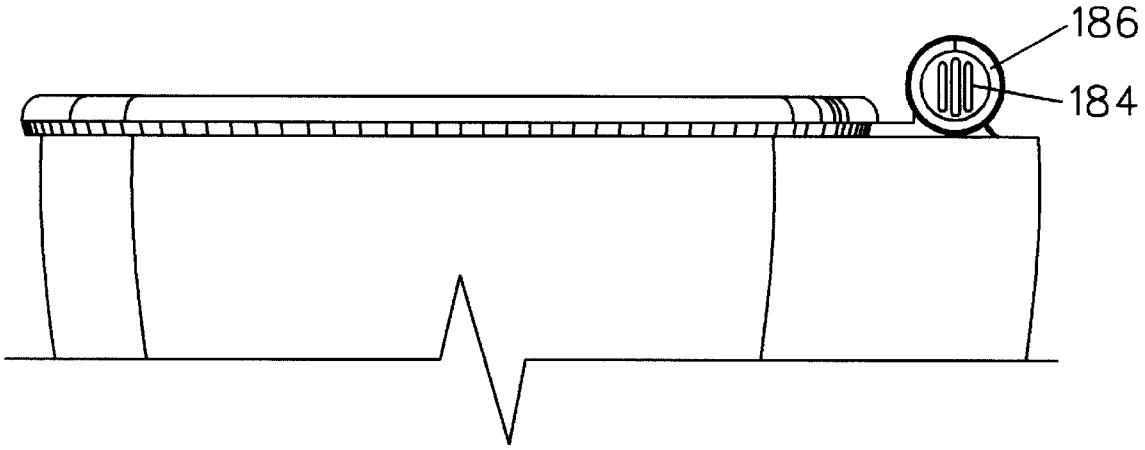
FIG. 3 is a fragmentary side view of the assembly of FIG. 2 with the toilet lid removed.
Figure 4:
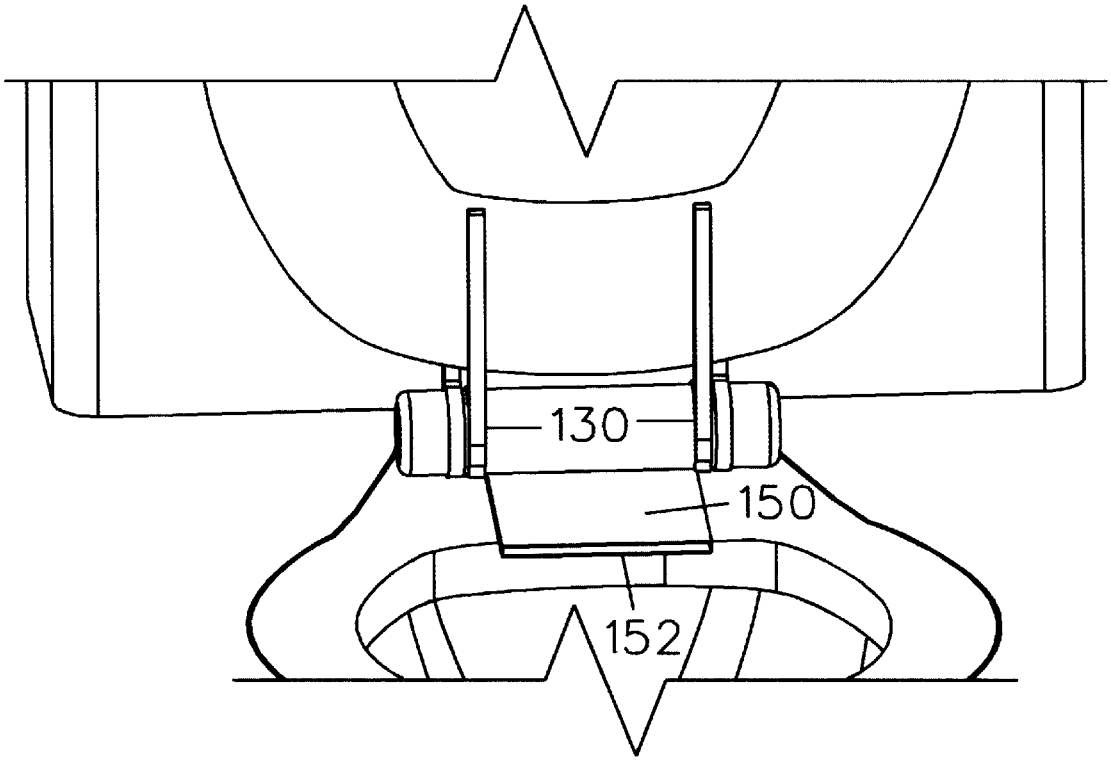
FIG. 4 is an fragmentary front view of the toilet of FIG. 1 with the toilet seat swung to a raised position.
Figure 5:
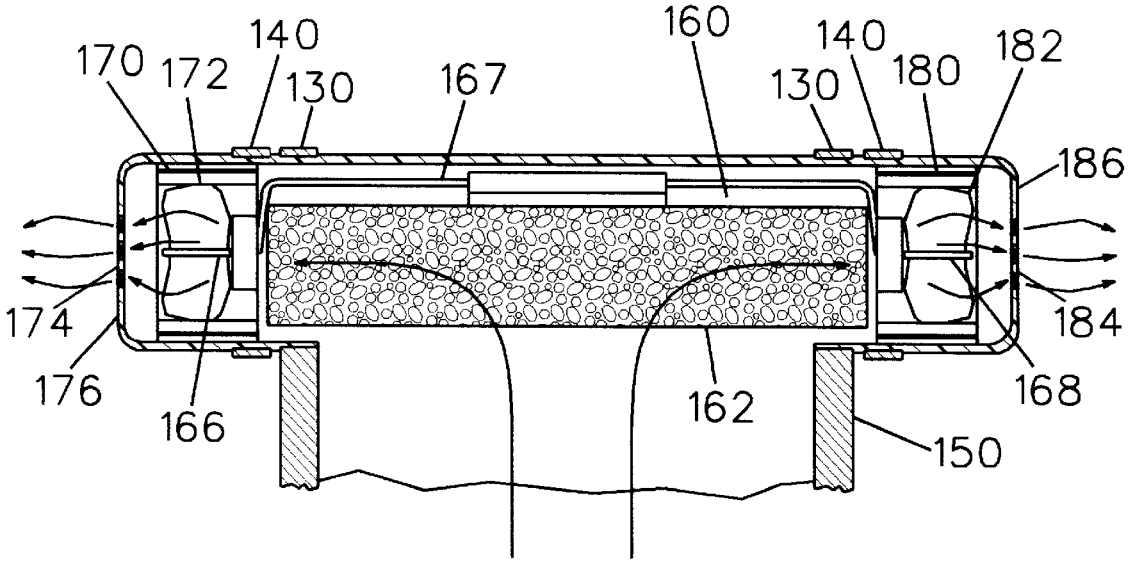
FIG. 5 is a top sectional view of the air treatment assembly, on an enlarged scale, showing the internal blower and filter elements and air flow therein.
Figure 6:
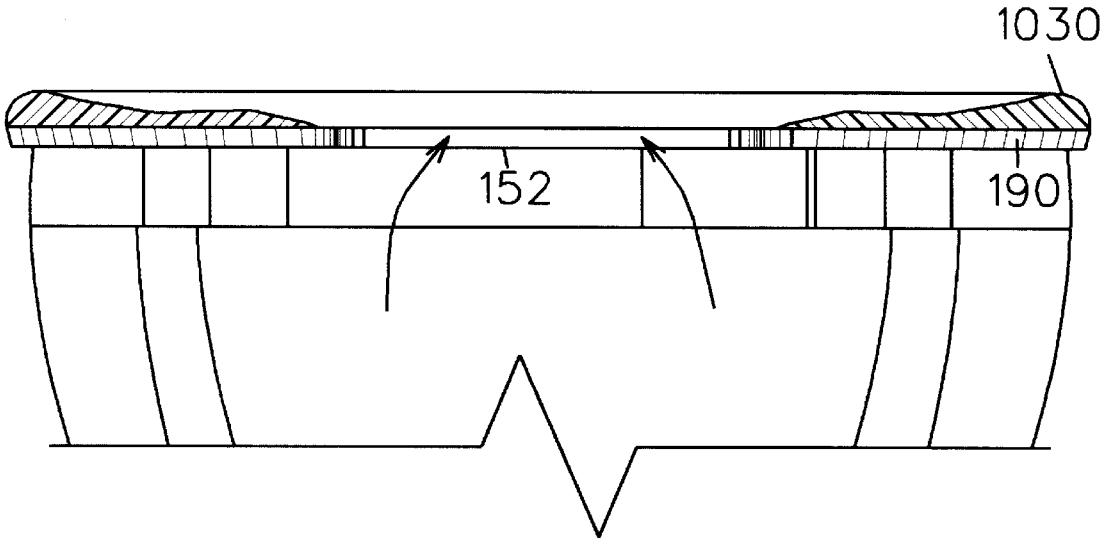
FIG. 6 is a fragmentary, front sectional view of the toilet diagrammatically showing the passage of air into the duct of the air treatment assembly.
Figure 7:
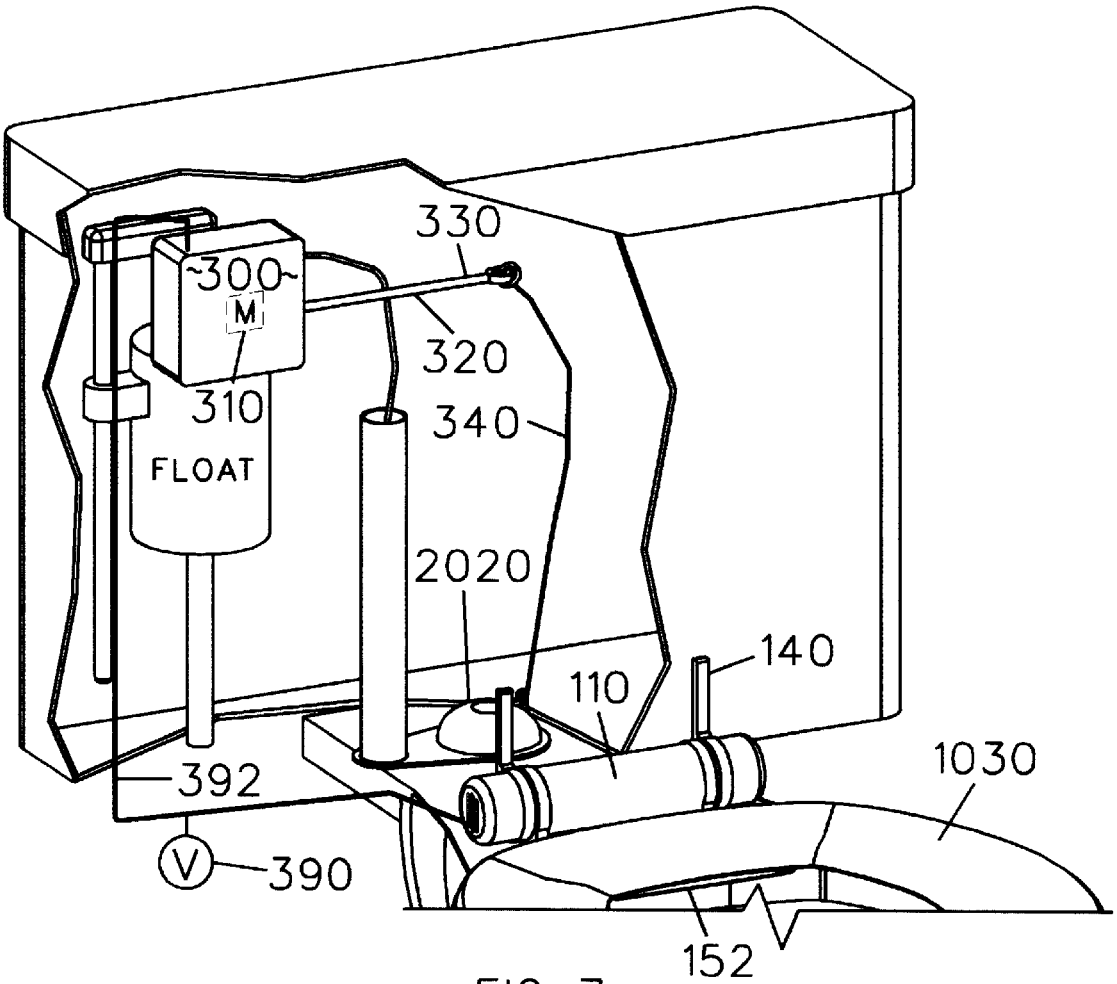
FIG. 7 is a fragmentary perspective view of a toilet with the toilet removed and a portion of the water tank broken away to show the flush assembly therein.
Figure 8:
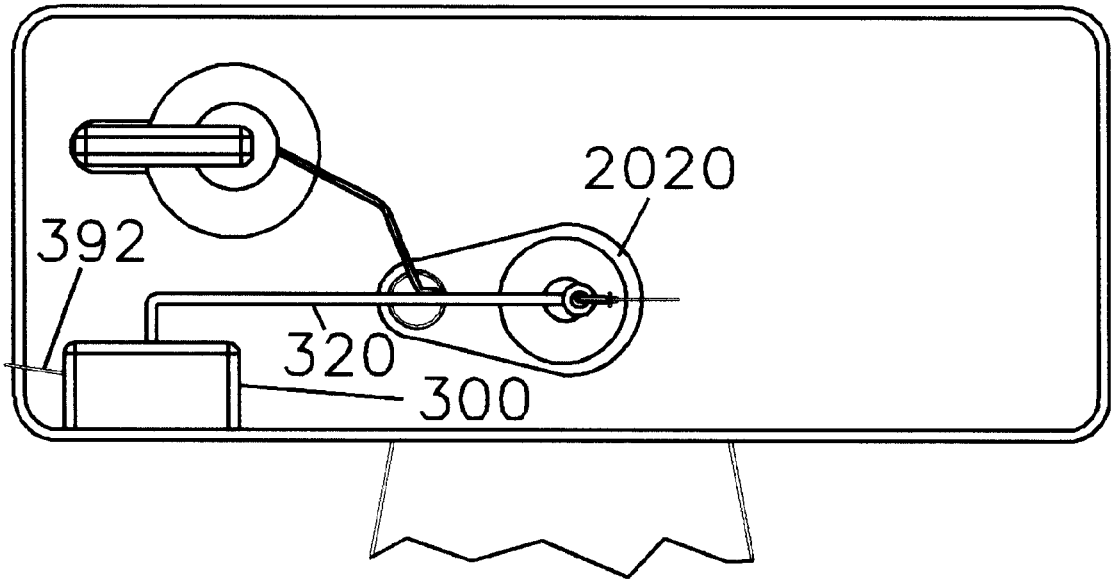
FIG. 8 is a top view of the water tank structure of FIG. 7 with lid removed.
Figure 9:
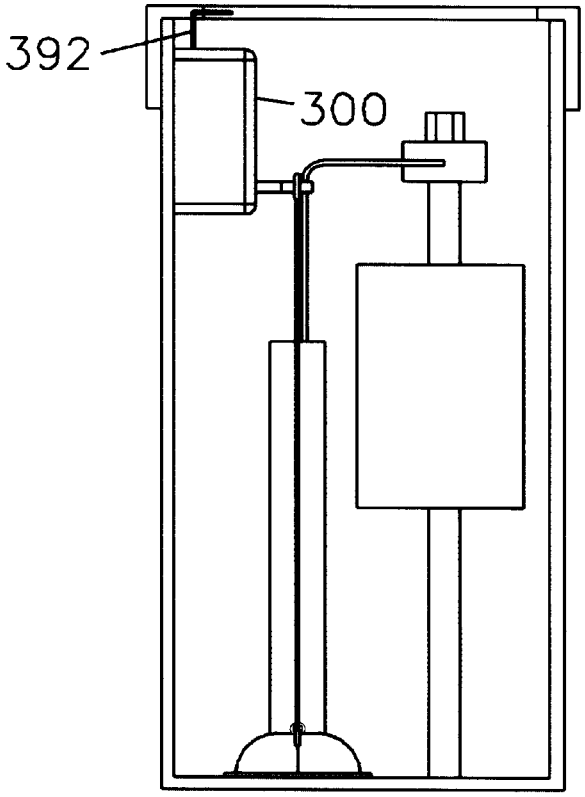
FIG. 9 is a right side view of the structure of FIG. 7.

Turning more particularly to the drawings, FIG. 1 shows a conventional toilet 1000 comprising a toilet bowl 1010 with water tank 1020, the bowl 1010 having a seat 1030 and lid 1040 swingably mounted thereon.

Mounted to the rear of the toilet bowl 1010 is an air treatment assembly 100 including a cylindrical housing 110. Seat 1030 and lid 1040 are swingably mounted to housing 110 by means of collars 130, 140 rotatably mounted about the housing 110.

Air duct 150 communicates at one end with a compartment 160 within housing 110. Included in compartment 160 is a carbon filter 162. It is understood that the housing 110 may be constructed to allow access and release of the carbon filter 162 to allow for replacement thereof, e.g. by a lid on the housing 110. It is also understood that the filter 162 may be scented so as to add fragrance to the treated air.

On each side of compartment 160 are two blower zones 170, 180, having fans 172, 182 mounted to an end 166, 168 of bracket 167 mounted within housing 110. Vents 174, 184 are located in the opposed end walls 176, 186 of the housing 110.

The housing 110 is mounted to the rear rim of the toilet bowl 1010 such that inlet 152 of duct 150 extends into the interior of the toilet bowl 1010. Underlying the toilet seat 1030 is a seal 190 which contacts the rim 1012 of bowl 1010 when seat 1030 is in a down, horizontal position. The seal 190 is interrupted at the rear of the seat 1030 to allow for extension of the air duct 150 under seat 1030 and into bowl 1010.

Figure 10:
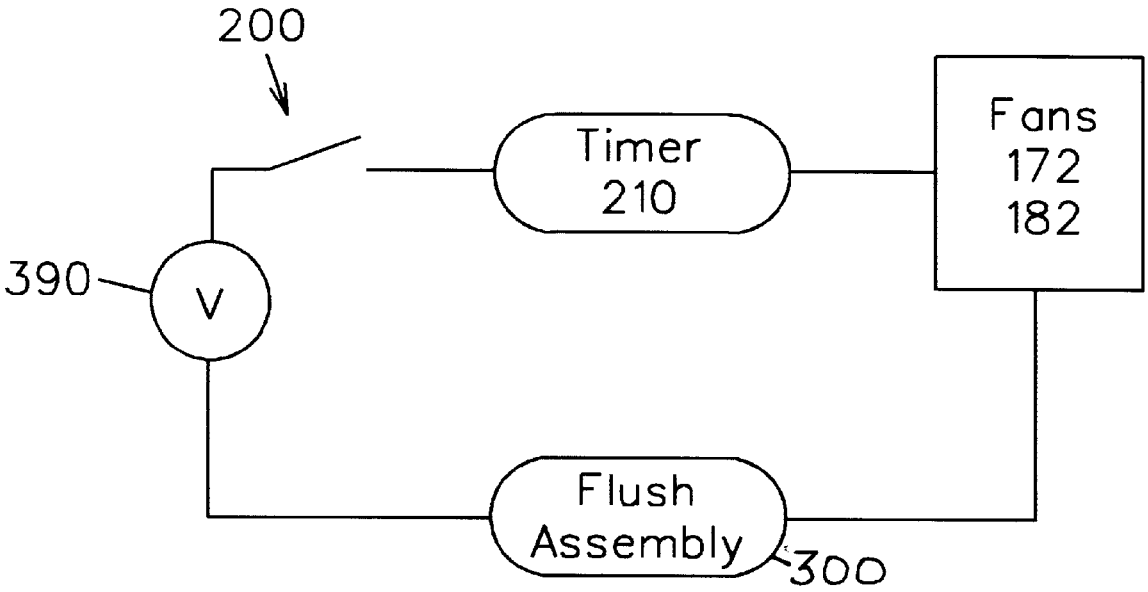
FIG. 10 illustrates one form of circuitry for energizing the air treatment assembly and flush mechanism.

Fans 172, 182 are incorporated into a circuit for energization by a power source 390 wired 392 thereto, e.g. household current or batteries, one form of circuitry being shown in FIG. 10. Embedded in the seat 1030 is a pressure responsive switch 200 which closes the open circuit upon sensing a pressure differential therein either by an increase in pressure being exerted on the switch 200 or pressure being released therefrom. A timer 210 regulates the period of current delivery by the closed circuit.

Mounted on wall 2010 of the water tank 2000 is a flush assembly 300, incorporated into the FIG. 10 circuitry, and is energized by switch 200 closure. The flush assembly 300 includes motor 310 with an arm 320 extending therefrom, the free end 330 of arm 320 being attached to the conventional flapper valve 2020 by means of linkage 340. Energization of motor 310 raises the arm 320 and the flapper valve 2020 linked thereto. Upon the arm 320 reaching its zenith, the raised flapper 2020 falls to its closure position causing arm 320 to return to its original position. Arm 310 may also be manually activated by a lever (not shown).

In use, either by pressure being exerted on the switch 200 in toilet seat 1030 or released thereon, the air in the toilet bowl 1030 will be drawn through duct 150 and filter 162 by the energized fans 172, 182. The filter treated air is then discharged through vents 174, 184. Concurrently the elevating arm 320 raises the flapper valve 2020 allowing the water to escape tank 2000 causing a flushing of the toilet bowl 1010. Timer 210 in the FIG. 10 circuitry will cease rotation of the fans 172, 182 after a designed time period.

Alternatively, the circuit can be designed such that the fans 172, 182 will be activated only upon pressure being exerted on the seat 1030 with the flushing mechanism assembly 300 then being energized upon release of the pressure from the seat 1030. Also, a switch responsive to a user motion may be used in lieu of a pressure differential switch.

It is thus understood that various circuits can be designed so as to activate the air treatment assembly 100 and flush assembly 300 either in tandem or in sequence according to the desires of the user. Thus, our system assures not only a treatment of the fouled air but also an evacuation of the contents of the toilet bowl 1030.

It is to be understood that while a certain best mode of this invention has been illustrated and described, it is not limited thereto except insofar as such limitations are included in the following claims and allowable functional equivalents thereof.

Having thus described the invention, what is claimed as new and desired to be secured by Letters Patent is as follows:

1. An air treatment system for use with a toilet having a bowl with a rim, a seat and a water tank, said system comprising:

a housing having first and second opposed ends;

vents in said housing;

an air duct having a first end in communication with an interior of said housing and a second free end displaced from said housing, said housing adapted to be mounted to a portion of the rim of the toilet bowl with said free end of said duct extending into an interior of the toilet bowl;

means for swingably mounting a toilet seat to said housing in a first position with the seat atop the toilet bowl rim and a second position displaced therefrom;

a seal adapted for placement on the toilet seat for contact with the rim upon the seat being in said first position;

an air filter in said housing and adjacent said first end of said air duct;

a circuit for delivering a current upon closure thereof;

blower means in said housing and in said circuit for drawing air from an interior of the toilet bowl and into said air duct free end upon a current delivery thereto, said blower means further drawing air through said filter for interface therewith;

a normally open switch means in said circuit and adapted to be embedded in the toilet seat, said switch means responsive to a seated user pressure on the toilet seat for closing said circuit whereby to cause a current flow in said circuit to said blower means;

a flush assembly adapted to be mounted in the water tank, said assembly comprising:

a motor in said circuit;

an arm having a first end operably attached to said motor and a second free end;

means for linking said free end of said arm to a flapper valve in the water tank, said closed circuit delivering a current to said motor to move said arm and the flapper valve linked thereto from a first closed to a second open position upon a release of said pressure on said switch means in the toilet seat, said open position allowing for evacuation of water from the water tank whereby to flush the associated toilet bowl; and a timer in said circuit for continuing to deliver current to said blower means for a period of time after said release of pressure on said switch means in the toilet seat.

2. The system as claimed in claim 1 wherein a return of the flapper valve from the open to the closure position returns said arm linked thereto to said first position.

3. The system as claimed in claim 1 wherein said swingable mounting means comprises at least one collar rotatably mounted about said housing and adapted to be connected to the toilet seat, a rotation of said at least one collar swinging said mounted toilet seat and seal thereon between said first and second positions.

4. The system as claimed in claim 3 wherein said duct is intermediate the toilet bowl rim and said seat in said first position.

5. The system as claimed in claims 3 further comprising means for mounting a lid for the toilet seat between a first position atop the seat and a second position displaced therefrom.

6. The system as claimed in claim 5 wherein said lid mounting means comprises a collar rotatably mounted about said housing and adapted to be connected to the lid, a rotation of said collar swinging the lid between said first and second positions.

7. An air treatment system for use with a toilet having a bowl with rim, a seat and a water tank, said system comprising:

a housing having first and second opposed ends;

an air inlet having a first end in communication with an interior of said housing and a second free end displaced from said housing, said housing mounted to a portion of the rim of the toilet bowl with said free end of said inlet extending into an interior of the toilet bowl;

an air outlet in said housing;

a seal adapted to be placed on the underside of the toilet seat for contact with the toilet bowl rim;

means for swingably mounting the toilet seat to said housing in a first position with said seal in said contact with the toilet bowl rim and a second position displaced therefrom;

an air filter in said housing and adjacent said first end of said air inlet;

an electrical circuit comprising:

a power source;

blower means in said housing for drawing air from an interior of the toilet bowl and into said air inlet free end upon a closure of said circuit, said blower means further drawing air through said filter for interface therewith and discharge from said outlet;

switch means adapted to be located in the toilet seat responsive to a user exerted pressure thereon for closing said circuit and operating said blower means;

a flush assembly adapted to be mounted in the water tank, said assembly comprising:

a motor in said circuit;

an arm having a first end operably attached to said motor and a second free end;

means for linking said free end of said arm to a flapper valve found in the water tank, said switch means responsive to a pressure differential caused by a user interaction with the seat for energizing said motor to cause a movement of said arm and displace the flapper valve attached thereto from a closure position, said displacement allowing for evacuation of water from the water tank whereby to flush the associated toilet bowl.

8. The system as claimed in claim 7 further comprising a timer in said circuit for regulating a period of said closure of said circuit.

9. An air treatment system for use with a toilet having a bowl and a water tank, said system comprising:

a housing having first and second opposed ends; an air inlet having a first end in communication with an interior of said housing and a second free end displaced from said housing, said housing mounted to a portion of a rim of a toilet bowl with said free end of said inlet extending into an interior of the toilet bowl;

an air outlet in said housing;

an air filter in said housing and adjacent said first end of said air inlet;

a circuit for producing a current flow comprising:

a power source;

blower means in said housing for drawing air from an interior of the toilet bowl and into said air inlet free end upon a closure of said circuit, said blower means further drawing air through said filter for interface therewith and discharge from said outlet;

sensor means associated with the toilet and responsive to a user interface with the seat for closing said circuit and operating said blower means, said sensor further causing an operation of a flush assembly, said flush assembly adapted to be mounted in the water tank and comprising:

a motor in said circuit;

a flapper valve adapted for placement in the water tank;

means for operably linking said motor to said flapper valve, said sensor means responsive to user movement adjacent the toilet for closing said circuit and energizing said motor to cause a movement of said flapper valve linked thereto from a closure position, said flapper valve displacement allowing for evacuation of water from the water tank whereby to flush the associated toilet bowl.

10. The system as claimed in claim 9 wherein said circuit further comprises a timer means for regulating a time period of said closure of said circuit.

11. The system as claimed in claim 9 wherein said sensor means comprises a pressure sensitive switch associated with the toilet seat, said switch closing upon sensing a user movement exerting a pressure differential on the toilet seat.

* * * * *